US011056759B2

(12) United States Patent
Nguyen et al.

(10) Patent No.: US 11,056,759 B2
(45) Date of Patent: Jul. 6, 2021

(54) HYBRID COUPLER WITH SUM AND DIFFERENCE PORTS LOCATED ON THE SAME SIDE

(71) Applicant: VIETTEL GROUP, Ha Noi (VN)

(72) Inventors: Tat Thang Nguyen, Ha Noi (VN); Ngoc Viet Tung Dinh, Hai Phong (VN); Hoang Viet Tran, Ha Noi (VN); Thi Huong Ngo, Ha Noi (VN); Dinh Toai Pham, Tam Diep (VN)

(73) Assignee: VIETTEL GROUP, Ha Noi (VN)

( * ) Notice: Subject to any disclaimer, the term of this patent is extended or adjusted under 35 U.S.C. 154(b) by 8 days.

(21) Appl. No.: 16/668,220

(22) Filed: Oct. 30, 2019

(65) Prior Publication Data

US 2020/0176849 A1 Jun. 4, 2020

(30) Foreign Application Priority Data

Nov. 29, 2018 (VN) ..... 1-2018-05349

(51) Int. Cl.

| | |
|---|---|
| ***H01P 5/18*** | (2006.01) |
| ***H01P 5/12*** | (2006.01) |
| ***H01P 5/22*** | (2006.01) |

(52) U.S. Cl.
CPC ..... *H01P 5/225* (2013.01); *H01P 5/184* (2013.01)

(58) Field of Classification Search
CPC .... H01P 5/12; H01P 5/18; H01P 5/184; H01P 5/22; H01P 5/225
See application file for complete search history.

(56) References Cited

U.S. PATENT DOCUMENTS

| | | | | |
|---|---|---|---|---|
| 5,003,622 | A * | 3/1991 | Ma | H01P 5/10 333/26 |
| 6,483,397 | B2 * | 11/2002 | Catoiu | H01P 5/12 333/116 |
| 7,319,370 | B2 * | 1/2008 | Napijalo | H01P 5/185 333/116 |
| 2014/0125427 | A1 * | 5/2014 | Moon | H01P 5/222 333/117 |

* cited by examiner

*Primary Examiner* — Dean O Takaoka
(74) *Attorney, Agent, or Firm* — PatentTM.US

(57) ABSTRACT

This invention refers to hybrid coupler with the sum port and difference port located on the same side. The hybrid coupler can be efficiently integrated into the high frequency circuit with its simple structure, using common material. To achieve this purpose, the hybrid coupler in this invention consists of the following parts: sum port, difference port, output port 1, output port 2, connection line 1, connection line 2 and microstrip line.

5 Claims, 4 Drawing Sheets

HYBRID COUPLER WITH SUM AND DIFFERENCE PORTS LOCATED ON THE SAME SIDE

TECHNICAL FIELD OF INVENTION

The invention refers to a hybrid coupler with sum and difference ports located on the same side. In particular, the hybrid coupler in this invention uses the slot structure, it is the passive component used for power combining and dividing in many microwave circuit applications.

TECHNICAL STATUS OF THE INVENTION

The hybrid coupler is a four port network device commonly used for power combining and dividing. Due to its versatile operational characteristics it is also used to get sum and difference of two input signals. It has been used as a key component in many microwave circuit applications such as balanced mixers and amplifiers, antenna beamforming networks. The hybrid coupler technical requirements include: Operating frequency band, impedance, standing wave ratio, amplitude and phase imbalance at the two output ports when signal enters the sum and difference port, the isolation between the sum port and difference port.

Current hybrid couplers (typically rat race couplers) are usually designed to meet the above technical requirements but the sum port and difference port are located opposite to each other, making it difficult to integrate the hybrid coupler into the system. In particular, the cable connected to the sum port is usually longer than the cable connected to the difference port. New design methods in this invention can put the sum port and the difference port of the hybrid coupler on the same side, which means the two ports are adjacent to each other. Combined with its simple structure, using common materials, the hybrid coupler can be efficiently fabricated to microwave circuits.

TECHNICAL IDEAL OF THE INVENTION

The purpose of this invention is to put the sum port and difference port of the hybrid coupler on the same side. The hybrid coupler has 4 ports based on 2 layer printed circuit that overcome the disadvantage of known hybrid couplers, and has many advantages such as simpler, more efficient structure.

To achieve the above purpose, the hybrid coupler is designed based on the 2-layer printed circuit and has 4 ports: Sum port, difference port, output 1, output 2, connection line 1, connection line 2 and the microstrip line.

DESCRIPTION OF INVENTION

Figure 1:
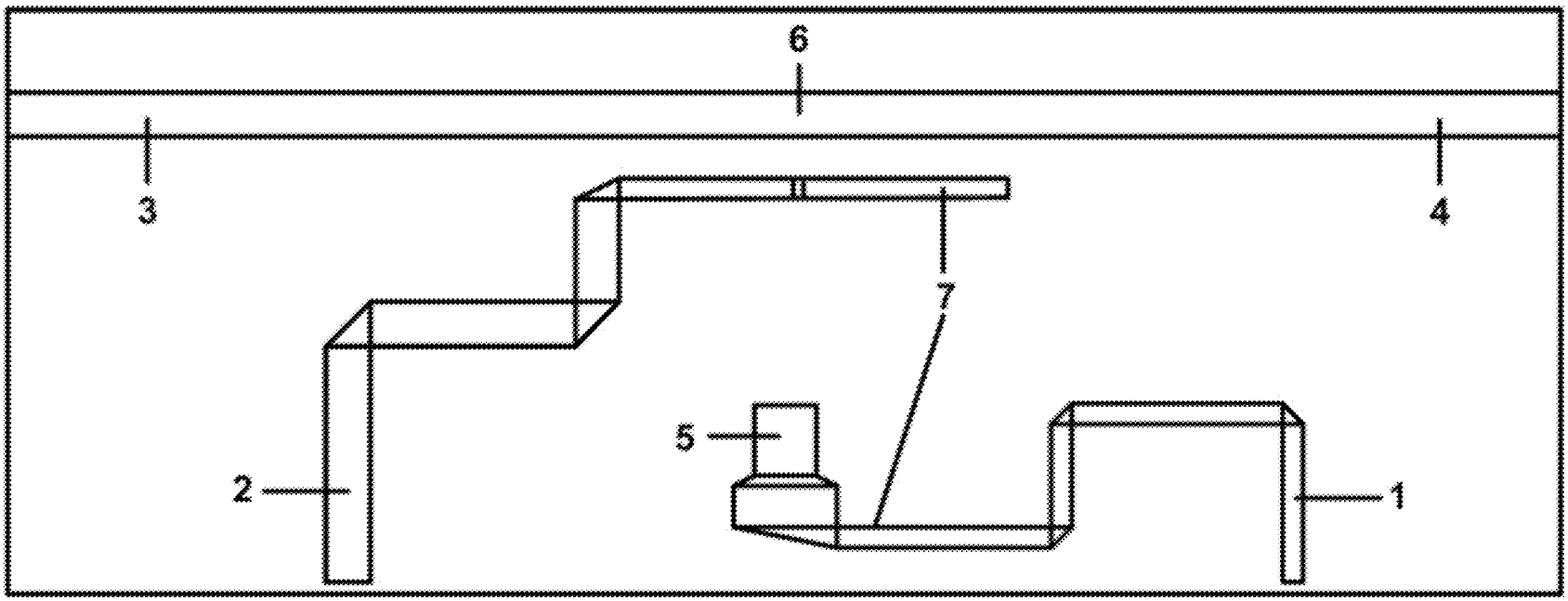
FIG. 1: Top layer of the hybrid coupler.

The hybrid coupler in this invention includes: Sum port (1), difference port (2), output port 1 (3), output port 2 (4), connection line 1 (5), connection line 2 (6) and the microstrip line (7)

Figure 2:
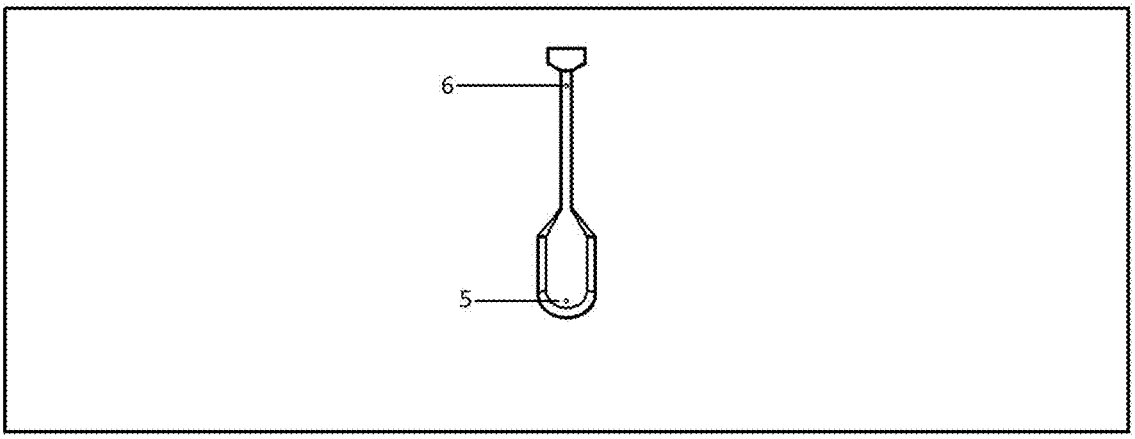
FIG. 2: Bottom layer of hybrid coupler.
Figure 3:
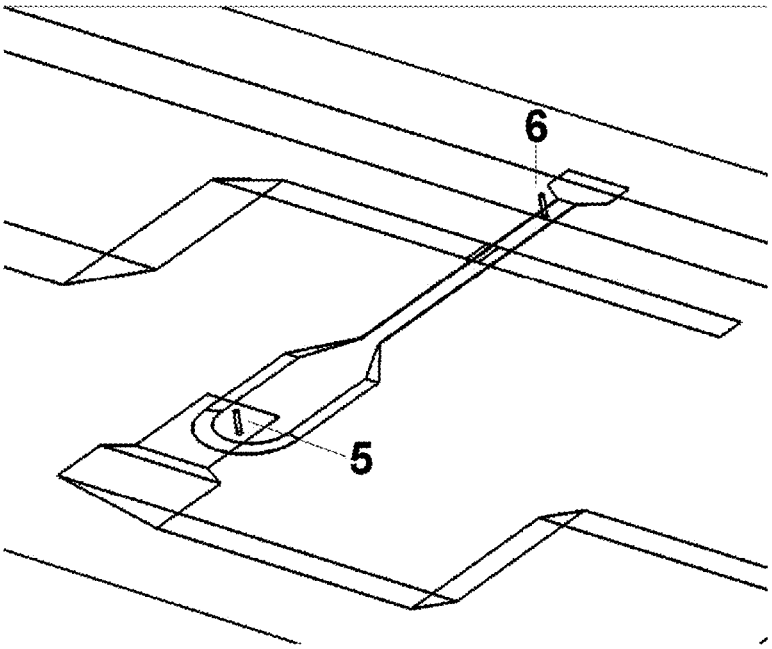
FIG. 3: Connection lines position.

Referring to FIG. 1, FIG. 2 and FIG. 3, sum port (1) and difference port (2) have the copper microstrip structure. To locate the sum port (1) and difference port (2) on the same side, signal from the sum port and difference port are transmitted to output port 1 (3) and output port 2 (4) (which also made by copper and have microstrip structure) via the microstrip line (7), connection line 1 (5), connection line 2 (6) (refer to FIG. 3) and slot-line structure in the bottom layer (refer to FIG. 2).

Figure 4:
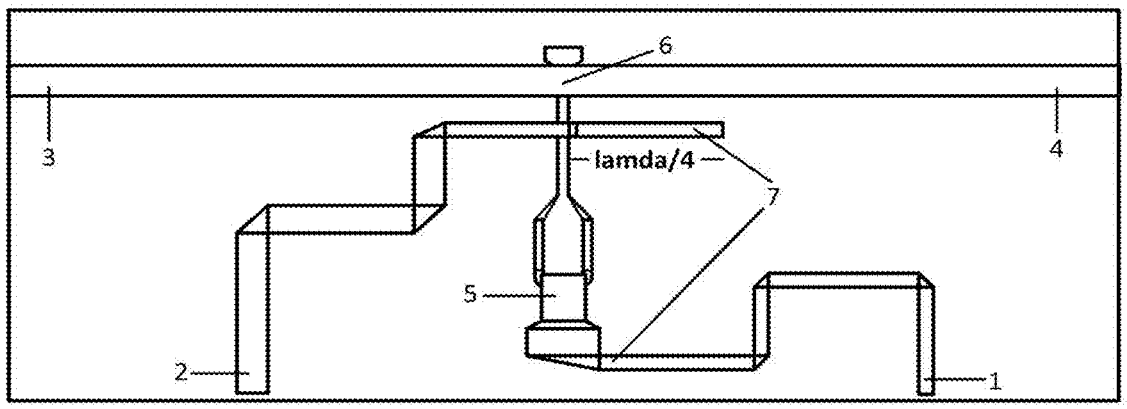
FIG. 4: Relative position of top and bottom layer.
Figure 5:
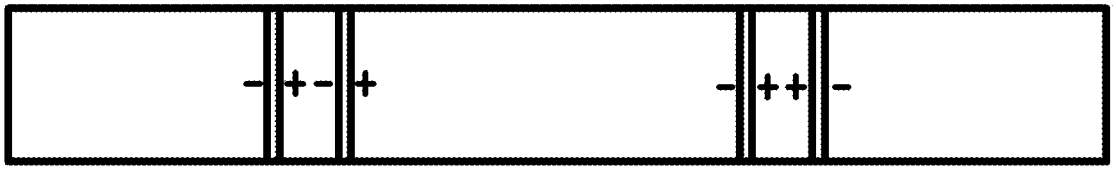
FIG. 5: Even and odd mode

Referring to FIG. 4 and FIG. 5, signal from the sum port (1) is transmitted to microstrip line (7), then transformed to the odd mode signal that transmitted on 2 slot-line via the connection line 1 (5). The odd mode signal is then transformed to the microstrip line via the connection line 2 (6) and transmitted to output port 1 (3) and output port 2 (4). The slot-line, connection line 1 (5), connection line 2 (6), output port 1 (3) and output port (4) are designed so that the output port 1 (3) and output port 2 (4) are symmetrically located to the slot structure. Due to the symmetry of the 2 output port (3), (4) and the odd mode characteristic, the output signals of output port 1 (3) and output port 2 (4) have the balanced amplitudes and phases.

Referring to FIG. 4 and FIG. 5, signal from the difference port (2) transmitted to microstrip line (7), transformed to the even mode signal that is transmitted on slot-line. The odd mode signal is transformed to the microstrip line via the connection line 2 (6) and transmitted to output port 1 (3) and output port 2 (4). Due to the symmetry of the 2 output ports (3), (4) and the even mode characteristic, the output signals of output port 1 (3) and output port 2 (4) have balanced amplitudes but are 180° phase-shifted. To achieve the even mode signal on the slot-line, the length of the microstrip line connected to difference port (2) must be lambda/4 (lambda is the center frequency wavelength).

The microstrip line dimensions are designed based on the microstrip line calculation principle, the slot-line dimensions are designed based on the calculation principle of coplanar waveguide and the material characteristic of dielectric layer (dielectric constant, dielectric layer thickness) to meet the operating frequency requirement and the impedance requirement of the (1), (2), (3) and (4) ports (the impedance of ports in this invention is 50 Ohm). The dielectric layer characteristics in this invention: dielectric constant is 2.64, dielectric layer thickness is 1.542 mm, top and bottom copper layers thickness is 0.035 mm.

The sum port (1) and difference port (2) are arranged on the same side and symmetrically to the slot-line. The lengths of microstrip lines (7) connected to sum port (1) and difference port (2) are calculated and designed so the phases of received signal from port 1 (3) to the sum port (1) and difference port (2) are in-phase.

Because the even mode and odd mode have the 180° phase-shifted characteristic so the signal from sum port (1) will almost be canceled at the difference port and vice versa, thereby the isolation between sum and difference ports is perfect.

In conclusion, this invention introduces a hybrid coupler with sum port and difference port located on the same side, the fabrication of hybrid coupler to the system becomes much simpler. The invention presents the hybrid coupler taking advantages of 2 layer printed circuit technology, using common material to meet the hybrid coupler's technical requirements.

What is claimed is:

1. A hybrid coupler with the sum port and difference ports located on the same side of the straight-line that connects the two outputs, the hybrid coupler comprises: a sum port, a difference port, a first output port, a second output, a first connection line, a second connection line and microstrip lines:

The sum port and difference port have flat structure and are made of copper

The first output port and second output port have flat structure and are made of copper The first connection line, second connection line and microstrip line are made of copper.

2. A hybrid coupler with sum port and difference ports located on the same side of the straight-line that connects the two outputs, said hybrid coupler having microstrip lines, a slot-line, and a substrate with top and bottom copper layers, wherein: the microstrip line dimensions are designed based on a microstrip line calculation principle, the slot-line dimensions are designed based on a calculation principle of coplanar waveguide and the material of dielectric layer, wherein dielectric constant is 2.64, a dielectric layer thickness is 1.542 mm; top and bottom copper layers are 0.035 mm.

3. A hybrid coupler with a sum port and a difference port located on the same side:

a signal from the sum port is transmitted to a microstrip line, then transformed to an odd mode signal that is transmitted on a slot-line via a first connection line, an odd mode signal is transformed to the microstrip line via a second connection line and transmitted to a set of output ports; the slot-line, first and second connection lines, the output ports are designed so that the output ports are symmetrically located to the slot-line structure; wherein, due to the symmetry of the two output ports and odd mode characteristics, the output signals of two output ports have balanced amplitudes and phases;

wherein signal from the difference port is transmitted to the microstrip line, is then transformed to the even mode signal that is transmitted on the slot-line.

4. The hybrid coupler according to claim 3, wherein even mode signal is then transformed to the microstrip line via the second connection line and is transmitted to two of the set of output ports.

5. The hybrid coupler according to claim 4, wherein due to the symmetry of the two output ports and the even mode characteristic, output signals of the two output ports have the equal amplitudes but 180 degree phase-shifted; wherein to achieve the even mode signal on slot-line, the length of the microstrip line connected to the difference port must be lambda/4, where lambda is a center frequency wavelength.

* * * * *